US009343814B2

(12) United States Patent
Peng

(10) Patent No.: US 9,343,814 B2
(45) Date of Patent: May 17, 2016

(54) WIDEBAND HIGH GAIN 3G OR 4G ANTENNA

(71) Applicant: Mesh City Wireless, Grand Prairie, TX (US)

(72) Inventor: Sheng Peng, Lynnwood, WA (US)

(73) Assignee: MESH CITY WIRELESS, LLC, Grand Prairie, TX (US)

( * ) Notice: Subject to any disclaimer, the term of this patent is extended or adjusted under 35 U.S.C. 154(b) by 0 days.

(21) Appl. No.: 14/203,312

(22) Filed: Mar. 10, 2014

(65) Prior Publication Data

US 2014/0191915 A1 Jul. 10, 2014

Related U.S. Application Data

(63) Continuation of application No. 12/783,508, filed on May 19, 2010, now Pat. No. 8,669,908, and a continuation-in-part of application No. 12/419,213, filed on Apr. 6, 2009, now Pat. No. 8,063,841.

(60) Provisional application No. 61/234,200, filed on Aug. 14, 2009, provisional application No. 61/234,209, filed on Aug. 14, 2009, provisional application No. 61/075,296, filed on Jun. 24, 2008, provisional application No. 61/118,549, filed on Nov. 28, 2008, provisional application No. 61/042,737, filed on Apr. 5, 2008, provisional application No. 61/042,752, filed on Apr. 6, 2008.

(51) Int. Cl.

| | |
|---|---|
| ***H01Q 13/10*** | (2006.01) |
| ***H01Q 13/00*** | (2006.01) |
| ***H01Q 1/38*** | (2006.01) |
| ***H01Q 13/08*** | (2006.01) |
| ***H01Q 21/06*** | (2006.01) |

(52) U.S. Cl.

CPC ..... *H01Q 13/00* (2013.01); *H01Q 1/38* (2013.01); *H01Q 13/08* (2013.01); *H01Q 21/064* (2013.01)

(58) Field of Classification Search

USPC ..... 343/767, 770, 786, 795

See application file for complete search history.

(56) References Cited

U.S. PATENT DOCUMENTS

| | | | | |
|---|---|---|---|---|
| 5,541,611 | A * | 7/1996 | Peng | H01Q 13/085 343/767 |
| 8,564,491 | B2 * | 10/2013 | Peng | H01Q 13/08 343/700 MS |
| 8,669,908 | B2 * | 3/2014 | Peng | H01Q 1/38 343/767 |
| 8,730,116 | B2 * | 5/2014 | Peng | H01Q 21/293 343/767 |
| 8,912,967 | B2 * | 12/2014 | Peng | H01Q 13/10 343/767 |
| 2014/0333497 | A1 * | 11/2014 | Cooper | H01Q 13/085 343/753 |
| 2014/0354485 | A1 * | 12/2014 | Cooper | H01Q 1/38 343/700 MS |

* cited by examiner

*Primary Examiner* — Tan Ho

(74) *Attorney, Agent, or Firm* — Donn K. Harms

(57) ABSTRACT

A broadband antenna element for RF transmission and reception over cellular frequencies. The antenna element is formed of conductive material on a substrate surface of conductive material in the form of a pair of half portions extending in opposite directions to distal tips defining the widest distance of a mouth of a cavity. The mouth converges to reduce in cross-section to a narrowest point at a plurality of different flare angles defined by the edges of the two half portions in between the pair of half portions forming the element. The resulting antenna element radiates and receives a wide band cellular frequencies enabling a single element to serve different providers operating on different frequency bands in the cellular spectrum between 680 MHz to 1900 MHz.

10 Claims, 4 Drawing Sheets

WIDEBAND HIGH GAIN 3G OR 4G ANTENNA

This application is a continuation of U.S. patent application Ser. No. 12/783,508 filed on May 19, 2010, which claims the benefit of U.S. Provisional Patent Application No. 61/234,200 filed on Aug. 14, 2009, and U.S. Provisional Patent Application 61/234,209 filed on Aug. 14, 2009, and is a Continuation-in-Part Application of currently pending U.S. patent application Ser. No. 12/419,213 filed on Apr. 6, 2009, which claims priority to U.S. Provisional Application 61/075,296 filed Jun. 24, 2008, and to U.S. Provisional Application 61/118,549 filed Nov. 28, 2008, and to U.S. Provisional Application 61/042,737 filed Apr. 5, 2008, and to U.S. Provisional Application 61/042,752 filed Apr. 6, 2008, all of which are respectively incorporated herein in their entirety by reference.

BACKGROUND OF THE INVENTION

1. Field of the Invention

The present invention relates to broadband antennas for transmission and reception of radio frequency communications in arrays using multiple broadcast and reception streams. More particularly it relates to planar shaped antenna elements which are especially well adapted for cellular telephone communications and which are employable individually or using individual elements integrated into arrays. In use for a multiple-input and multiple-output scheme or MIMO, the formed elements of the array may be closely spaced yet broadcasted and received concurrently without the need for multiplexing. The element and assembled array performs especially well in the 700 Mhz, 900 Mhz, 1710 MHz, 1800 Mhz, and 1900 Mhz-2100 Mhz frequency ranges. A unique flare angle change at a mid section of the formed aperture in each element, enhances performance in the middle portion of the frequency bands.

2. Background of the Invention

Since the inception of cellular telephones, cellular service providers have had the task of installing a plurality of antenna sites over a geographic area to establish cells for communication with cellular telephones located in the cell. From inception to the current mode of cellular broadcasting and reception, providers have each installed their own plurality of large external cellular antennas for such cell sites. Generally, such antennas are or cable hookup is necessary to provide a television receiver with the required signal strength to provide a perfect picture and sound to the viewer.

In practice, cell sites are grouped in areas of high population density with the most potential users. Because each cellular service provider, has their own system, each such provider will normally have their own antenna sites spaced about a geographic area to form the cells in their respective system.

In suburban areas, the large dipole or mast type antennas must be placed within each cell. Such masts are commonly spaced 1-2 miles apart in suburban areas and in dense urban areas and may be as close as ¼-½ miles apart.

Such antenna sites with large towers and large masts are generally considered eyesores by the public. Because each provider has their own system of cell sites and because each geographic area has a plurality of providers, antenna blight is a common problem in many urban and suburban areas.

The many different service providers employ many different technologies such as GSM and CDMA using industry standards for 3G and 4G (short for 3rd and 4th generation). They also employ these technologies on bandwidths the provider either owns or leases, and which are adapted to the technologies. Consequently, the different carriers tend to operate on different frequencies and since conventional dipole and other cell antennas are large by conventional construction, even where the different providers are positioning sites near each other, they still have their own cell towers adapted to the length and configuration of the large antennas they employ for their systems and which are adapted to their individual broadcast and receiving bands in the RF spectrum.

Since the many carriers and technologies employ different sized, large antennas, even if they wanted to share cell sites and antennas more often, the nature of the antennas used conventionally discourages it. The result being a plethora of antenna sites, some right next to each other, with large ungainly and unsightly antennas on large towers which are aesthetically unpleasing.

In the case of 3G and 4G technologies, data is broadcast in multiple independent RF streams in schemes such as MIMO to communicated data and voice to and from multiple antennas adapted to handle the frequency of each stream. Antennas conventionally must be spaced from each other at least ½ a wavelength of the RF frequency on which they operate to avoid problems with interference. In the case of a broadband antenna with a low end frequency of 700 Mhz this can be at least a 17 inch spacing requirement of each of the plurality of antenna elements from each other. This physical requirement can be overcome using multiplexing of adjacent antennas to turn them off when one antenna is in broadcast mode or using complicated and expensive smart antenna schemes and switching techniques. However, performance lacks and is prone to problems using such techniques. Additionally, physical spacing, if employed, renders the antenna array for multi stream use very large if the lower frequencies are in the 600-800 MHz spectrum.

As such, there is a continuing unmet need for an improved antenna element and a method of cellular antenna tower or node construction which allows for easy formation and configuration of a cellular tower array for two way communications with customers. Such an array should allow for close spacing of the antenna elements of the array and concurrent reception and broadcast by the multiple antennas closely spaced in the array, without complicated switching or multiplexing. Further, such a device should employ individual antenna elements which provide a very high potential for the as-needed configuration for frequency, polarization, gain, direction, steering and other factors desired in a cellular system for the varying servicing requirements of varying numbers of users over a day's time.

Further, such a device should employ a wideband antenna radiator element able to service all of the frequencies employed by the multiple carriers from 700 MHz to 2100 MHz using MIMO or other multiple broadcast and reception data and voice streams without the need for individual antennas for each band. Such a device should also allow one antenna site to service multiple carriers and providers operating in their respective frequency ranges and eliminate the need for many towers virtually in the same position with each servicing a single carrier.

SUMMARY OF THE INVENTION

The disclosed antenna herein is especially adapted to handle the wide range of frequencies employed by multiple carriers in multiple cell systems in a geographic area. Formed of individual elements electrically connected to an elongated array, the individual arrays may be employed for MIMO and other multi-stream 3G and 4G communication's schemes with exceptional performance.

The unique configuration of the individual antenna radiator elements, with the flare angles of the edges of the two halves of the element forming a bump or node in a mid portion, provides excellent transmission and reception performance in a wide band of frequencies between 680 MHz to 1900 MHz and may be adapted easily to the 2100-2200 MHz. Such performance in such a wide bandwidth is accomplished with an array of antennas having spacing at 5½ inches instead of ½ the wavelength of the lowest frequency, which in this case would be at least 17 inches. The device, with such close spacing, can concurrently transmit and receive RF streams on all of the plurality of antennas continuously without switching or multiplexing.

This overcomes the problems associated with current MIMO and multiple antenna arrays for producing multiple RF streams for 3G and 4G systems. As noted, such systems currently must either separate all the antennas in the array from each other by a distance of ½ the wavelength of the longest bandwidth or use multiplexing and smart switching techniques and software to turn off adjacent closely spaced antennas to avoid interference. As also noted, the larger spacing requirements increases antenna array sizes and real estate and tower space required. Using smaller spacing on conventional MIMO and similar arrays however, as noted, involves complicated switching techniques and inhibits reliability and decreased throughput.

As such, the disclosed device employed in arrays will enable cellular carriers on widely varying bands to employ a single element for most employed frequencies and even share towers and antennas to reduce tower blight which is ever increasing in most countries.

The disclosed device, employing changing flare angles to edge sides forms a unique cavity from the widest point at an aperture which changes in its evenly declining slope toward a center line at a first slope, then at a second slope, and then to a third declining slope toward the center line of the aperture. This flare angle change has been found to provide a significant improvement in the cellular frequency ranges of the antenna in the middle portion between the 700-1900 MHz operating range of the antenna element.

Formed to individual antennas in an array, each individual antenna is formed of a plurality of individual elements electrically communicating with each other and the transceiver. Each antenna in the array may be employed singularly or engaged with adjacent elements for gain and steering and is planar and formed on a single side of a dielectric substrate of such materials as MYLAR, fiberglass, REXLITE, polystyrene, polyimide, TEFLON, fiberglass or any other such material suitable for the purpose intended. The substrate may be flexible. However, in the current mode of the device wherein a plurality of antenna elements are engaged to each other to increase gain or broadcast and receipt footprint, the substrate is substantially rigid in nature. The antenna element formed on the substrate can be any suitable conductive material, as for example, aluminum, copper, silver, gold, platinum or any other electrically conductive material suitable for the purpose intended. The conductive material is adhered to the substrate by any conventional known technology.

So formed, and using a plurality of the multi-element antennas, the disclosed device provided forms an array for MIMO type multiple-stream transmission and receiving of individual RF streams. All antennas, in the formed array, may concurrently broadcast and receive on all bands, with less than wavelength spacing, and with no need for complicated multiplexing and switching of adjacent antennas in the array.

In a preferred embodiment, the antenna elements are formed of the conductive material coating on a single first side of the substrate. The cavity has opposing edges of the two halves of the antenna element at different slope angles which both slope toward a mid line of the element at a first slope, rises slightly for a distance toward the mid line, and then again traverses downward and toward the midline for the remainder of the cavity forming the antenna aperture. From a distance, the formed element as the general appearance of a cross-section of a "whale tail" having two substantially equal sized half-tail components, and with a throat portion therebetween narrowing in size and extending in curvilinear fashion from the perimeter of one tail section into the other forming the horn. A microstrip feed line is engaged to the element half adjacent to the throat at the bottom of the U-shaped curve of the throat. The feedline communicates energy at the communicated frequencies captured and transmitted by the antenna element to and from the antenna element.

The unique "whale-tail" configuration and central aperture having flare angles forming the horn antenna, and the unique changing direction and slope forming the convergence of the throat and the positioning of the feed line out of line with the center line of the antenna element, all combine to yield an antenna element of unique characteristics in that it will receive and transmit on multiple frequencies easily and can be joined with other elements to increase gain and shape the footprint yielded by the resultant antenna.

The antenna element so configured, will receive and transmit RF signals in all cellular bands at an improved performance level from conventional, large, unsightly antenna elements now used. It can be used by a plurality of different cellular providers on the same tower to thereby alleviate the need for multiple towers adjacent to each other for different carriers.

While employable in individual antenna elements, the elements may also be coupled into other arrays for added gain and beam steering and multiple stream MIMO type communications. The arrays may be adapted for multiple configurations using software adapted to the task of switching between radiator elements to form or change the form of engaged arrays of such elements. Using a plurality of elements, each substantially identical to the other and each capable of RF transmission and reception across a wide array of frequencies to form an array antenna, the device provides an elegantly simple solution to forming antennas which are highly customizable for frequency, gain, polarization, steering, and other factors for that user.

In a particularly preferred embodiment, the antenna element conductive material coating on a first side of the substrate is formed with a non-plated first cavity or covered surface area in the form of a horn. The formed horn antenna has the general appearance of a cross-section of a "whale tail" with two leaves or tail half-sections in a substantially mirrored configuration extending from a center to pointed tips positioned a distance from each other at their respective distal ends. Optionally, but preferred, mirrored "L" shaped extensions extend from those distal positioned tips. These extensions, while optional, have been found to significantly enhance performance of the antenna radiator element at lower frequency ranges.

A central aperture or cavity beginning with a large uncoated or unplated surface area of the substrate between the side edges of the two halves forms a mouth of the antenna and is substantially centered between the two distal tip points on each leaf or half-section of the tail shaped radiator element. The cavity extends substantially perpendicular to a horizontal line running between the two distal tip points and then curves into the body portion of one of the tail halves and extends away from the other half.

Along the cavity pathway, formed by the converging flare angles, from the distal tip points of the element halves, the cavity narrows according to a slope of the flare angles formed by the edges of the two halves of the antenna element in its cross sectional area. The cavity is at a widest point between the two distal end points and narrows to a narrowest point. The cavity from this narrow point curves to extend to a distal end within the one tail half, where it makes a short right angled extension from the centerline of the curving cavity.

The widest point of the cavity between the distal end points of the radiator halves, determines the low point for the frequency range of the element. The narrowest point of the cavity between the two halves determines the highest frequency to which the element is adapted for use.

Using a slope change yielding a change in the linear flare angle of the edge of the two halves toward a midline of the element, the disclosed device has been found to yield exceptional results between 680 Mhz to 1900 Mhz and up to 2200 Mhz. The changing flare angle in the mid portion of the converging edges has provided a significant improvement in gain in the middle portion of the frequency range and is especially preferred.

On the opposite surface of the substrate from the formed radiator element, a feedline extends from the area of the cavity intermediate the first and second halves of the antenna element and passes through the substrate to a top position to electrically connect with the element which has the cavity extending therein to the distal end perpendicular extension.

The location of the feedline connection, the size and shape of the two halves of the radiator element, and the cross-sectional area of the cavity, may be of the antenna designers choice for best results for a given use and frequency. However, because the disclosed radiator element performs so well and across such a wide bandwidth, the current mode of the radiator element as depicted herein, with the connection point shown, is especially preferred. Of course, those skilled in the art will realize that the shape of the half-portions and size and shape of the cavity may be adjusted to increase gain in certain frequencies or for other reasons known to the skilled. Any and all such changes or alterations of the depicted radiator element as would occur to those skilled in the art upon reading this disclosure are anticipated within the scope of this invention.

With respect to the above description, before explaining at least one preferred embodiment of the improved antenna element in detail, it is to be understood that the invention is not limited in its application to the details of operation nor the arrangement of the components or steps set forth in the following description or illustrations in the drawings. The various methods of implementation and operation of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices and systems for carrying out the several purposes of the wideband antenna element herein. It is important, therefore, that the objects and claims be regarded as including such equivalent construction and methodology insofar as they do not depart from the spirit and scope of the present invention.

Further objectives of this invention will be brought out in the following part of the specification wherein detailed description is for the purpose of fully disclosing the invention without placing limitations thereon.

It is thus an object of this invention to provide an antenna element that is particularly adapted to transmit and receive in all cellular bands, and thereby allow a standardized antenna that may be employed by multiple carriers on single towers.

It is one principal object of this invention to provide an antenna element which will transmit and receive radio waves across a wide array of frequencies, in a single element, and therefor eliminates the need for other differently shaped or elongated elements.

It is an object of this invention to provide an antenna that may be constructed in an array formed of individual such elements as modular components to thereby increase gain and steering of the formed antenna across a wide band of frequencies.

It is an additional object of this invention to provide such an improved antenna element wherein the gain may be increased or decreased by combining or separating adjacent respective horizontal and vertically disposed antenna elements.

Another object of the invention, is the employment of the antenna elements to form individual antennas in an array which may be closely spaced without the need for smart antenna switching or other schemes.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF DRAWING FIGURES

FIG. 1 depicts a top plan view of the preferred mode of the antenna element herein shaped similarly to a "whale tail" positioned on a substrate showing the distal points forming the widest point of the cavity "W" which narrows to a narrowest point "N" at a position substantially equidistant between the two distal points. Also shown is the slope change of the flare angles defined by the edges of the two halves defining a central aperture. The changing slope yields a secondary wide point W1 which has been shown to enhance the mid portion of the spectrum.

Figure 3:
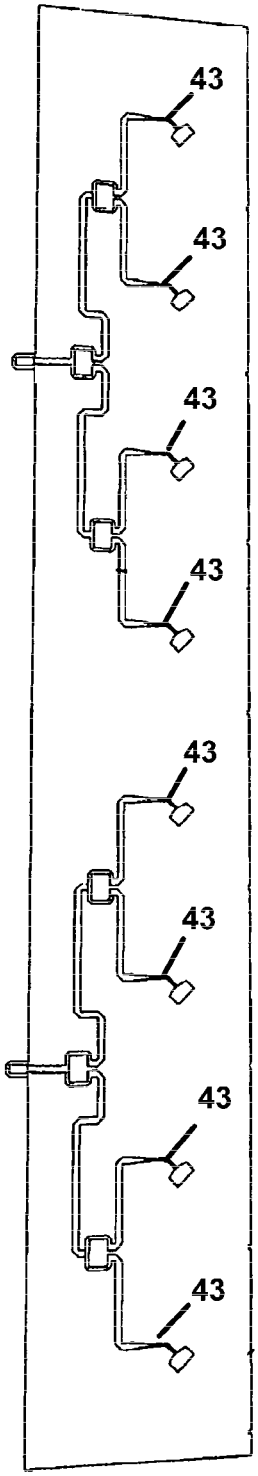
FIG. 3 depicts an antenna for the array formed of eight individual elements electrically connected.
Figure 4:
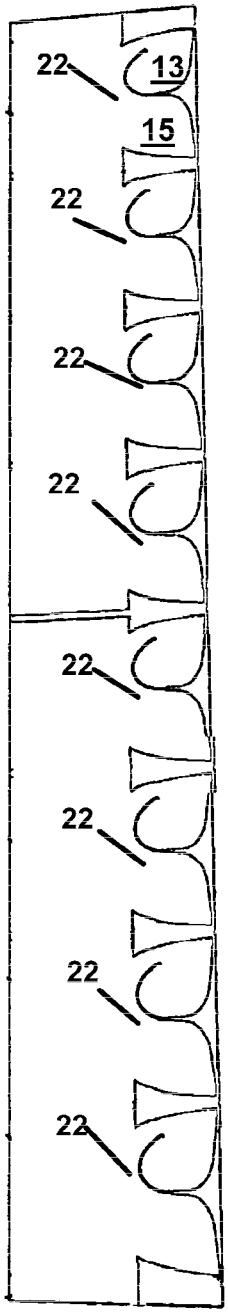

FIG. 4 the rear of FIG. 3 showing the connections of the elements to work in concert.

Figure 5:
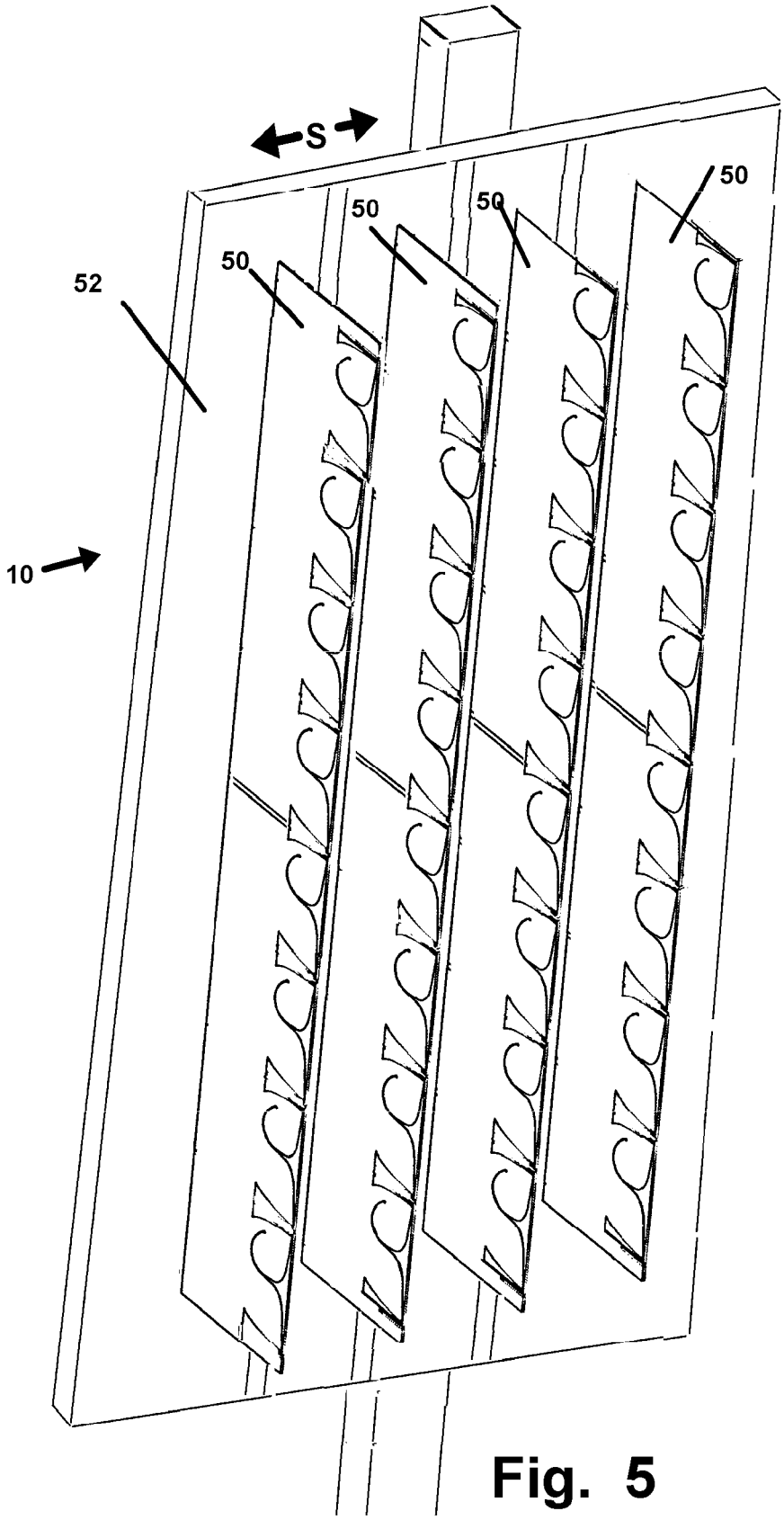

FIG. 5 depicts an array formed of the elements of FIG. 3-4.

DETAILED DESCRIPTION OF THE PREFERRED EMBODIMENTS OF THE INVENTION

Figure 1:
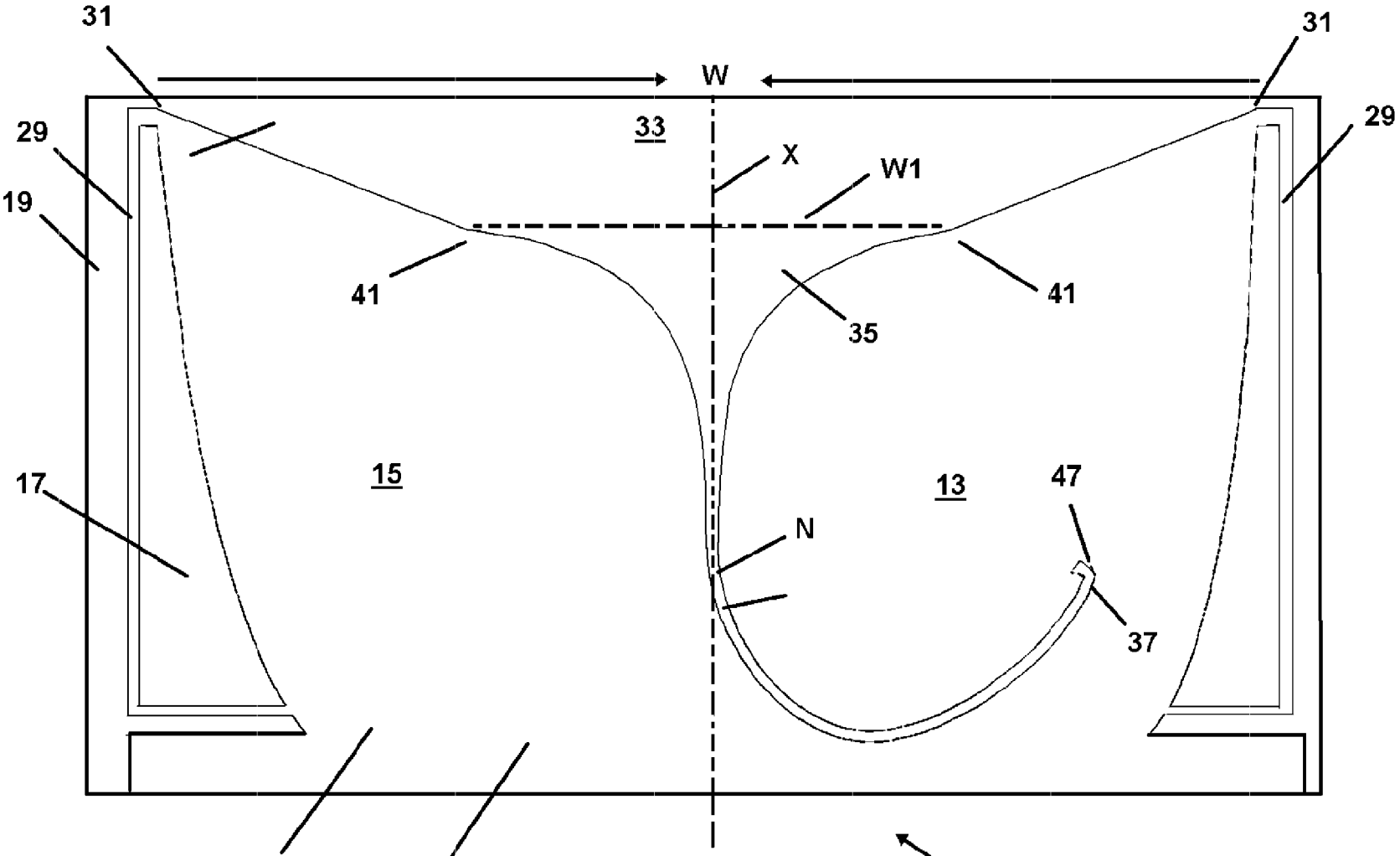
Figure 2:
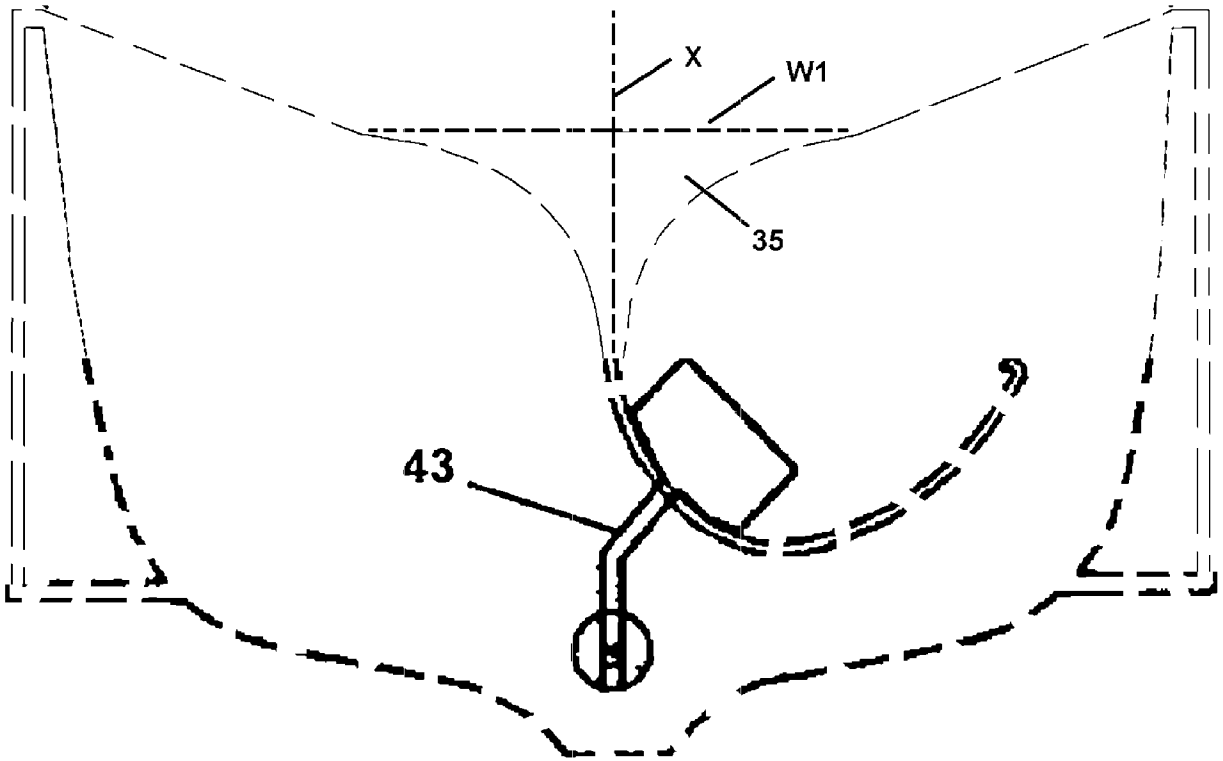
FIG. 2 depicts a rear side of the planar substrate on which the radiator element is mounted showing the feedline engaging the element to capture or transmit energy therefrom.

Referring now to the drawings of FIGS. 1-5, in FIGS. 1 and 2, depicting the antenna element 22 of the device 10, the element 22 shaped much like a "whale tail" is depicted having two half portions which are formed by a first half 13 and second half 15 looking much like leaves and being substantially identical or mirror images of each other. Each antenna element 22 of the invention is formed on a substrate 17 which as noted is non conductive and may be constructed of either a rigid or flexible material such as, MYLAR, fiberglass, REXLITE, polystyrene, polyamide, TEFLON fiberglass, or any other such material which would be suitable for the purpose intended.

A first surface 19 is coated with a conductive material by microstripline or the like or other metal and substrate construction well known in this art. Any means for affixing the conductive material to the substrate is acceptable to practice this invention. The conductive material 23 as for example, include but are not limited to aluminum, copper, silver, gold, platinum or any other electrical conductive material which is suitable for the purpose intended.

As shown in FIG. 1 the surface conductive material 23 on first surface 19 is etched away, removed by suitable means, or left uncoated in the coating process to form the first and second halves 13 and 15 of the antenna element, and having a mouth 33 leading to a curvilineal cavity 35.

Optionally, but especially preferred, mirrored "L" shaped extensions 29 extend from those tips 31 to a connection at the lower points of respective halves 13 and 15. The extensions 29 have been found to significantly enhance performance of the antenna radiator element device 10 at lower frequency ranges of the spectrum between 680-1900 MHz in which the antenna element excels.

The cavity 35 extending from the mouth 33 has a widest point "W" and extends between the curved side edges of the two halves 13 and 15 to a narrowest point "N" which is substantially equidistant between the two distal tips 31 and which is positioned along an imaginary line X substantially perpendicular the line depicting the widest point "W" running between the two distal tips 31 on the two horns 13 and 15.

The widest distance "W" of the mouth 33 portion of the cavity 35 running between the distal end points 31 of the radiator halves 13 and 15, determines the low point for the frequency range of the device 10. The narrowest distance "N" of the mouth 33 portion of the cavity 35 between the two halves 13 and 15 determines the highest frequency to which the device 10 is adapted for use.

Particularly preferred, in the device 10, is a mid portion of the cavity 35 along side edges of both halves 13 and 15 which have a flare angle slope change 41 toward the mid line X of the device. This mid portion starting at the ends of the line W1, occurs when the flare angles on the edges of the two halves 13 and 15, changes to a decreasing declining angle for a distance, whereafter the angle of decline toward the midline X increases again. This mid portion with the change in the flare angle defined by the edges of the halves 13 and 15 has been found to particularly increase performance in the mid range of the antenna element which currently operates between 680 Mhz and 1900 Mhz. The mid portion adjustment slope change 41 has also provided a means to fine tune the device and enhance impedance matching to allow for common matching circuitry of the device with other antennas of different sizes between W and N. The element will work well in other frequency ranges where W equals substantially ½ the wave length of the lowest frequency and N equals ½ the wavelength of the highest.

Currently the widest distance "W" is at a distance adapted to receive the lowest cellular frequencies in the 680 MHz, and narrowest distance "N" is at a distance adapted to receive the highest frequencies up toward and above the 1900 MHz high end.

The cavity 35 proximate to the narrowest distance "N" curves into the body portion of the first half 13 and extends away from the other the second half 15. The cavity 35 extends to a distal end 37 within the first half 13 where it makes a short right angled extension 47 away from the centerline of the curving cavity 35 and toward the midline X. This short angled extension 47 has shown improvement in gain for some of the frequencies.

On the opposite surface of the substrate 17 shown in FIG. 2, a feedline 43 extends from the area of the cavity 35 intermediate the two halves 13 and 15 forming the two halves of the radiator element 22 and passes through the substrate 17 to electrically connect to the first half 13 and second half 15 adjacent to the edge of the curved portion of the cavity 35 past the narrowest distance "N". As noted the change in the flare angles at the mid position 41 in the cavity 35 also enhances impedance matching of the device with others.

The location of the feedline 43 connection, the size and shape of the two halves 13 and 15, of the radiator element 22, and the cross-sectional area of the widest distance "W" and narrowest distance "N" of the cavity 35, and the change in slope angle along line W1, are adapted in size and distance to receive captured energy at cellular frequencies and in this configuration performs well and across the entire bandwidth and is especially preferred.

The radiator element 22 maintaining substantially the same "whale tail" appearance when viewed from above, may be adapted in dimension to optimize it for other RF frequencies between a maximum low frequency and maximum high frequence and those that fall therebetween. This may be done by forming said halves 13 and 15 to position the distal tips 31 at a widest point "W", which is substantially one half the distance of the length of an RF wave radiating at the maximum low frequency desired or alternatively but less preferred at one quarter the distance of the wave. To determine the maximum high frequency for the element 22, it would be formed with a narrowest point "N" of the mouth having a distance which is substantially one half or one quarter the distance of the length of the RF wave radiating at the highest frequency desired. This may be done by adjusting the curved edges defining the flare angels on edges of halves 13 and 15 slightly to accommodate the narrower or wider narrowest point "N". Once so formed, the radiator element 22 will receive and transmit well on all frequencies between the maximum high and low frequencies from 6800 MHz to 1900 MHz and beyond.

In all modes of the device adapted for cellular frequencies as described herein, the slope change 41 of the flare angles on the edges of the halves 13 and 15, toward the center line X, to form the mid portion is also preferred to enhance the mid spectrum gain and provide an aid in impedance matching of the device.

Because of this unique shape, the antenna element 22 provides a transmitting and receiving ability across the spectrum from 680 MHz to 1900 MHz. Each such element 22 is easily combined with others of identical shape, and connected electrically as in FIGS. 3-4 to form an array antenna, which becomes an element and a formed array device 11 as in FIG. 5. Such an array provides a means to increase gain and steer the beam of the formed antenna array allowing for more precise formation of individual cells in the cellular network.

As noted, because the single antenna element 22 with the changed slope of the flare angles performs well across the entire cellular frequency spectrum between 680 MHz to 1900 MHz, and up to 2200 MHz with an adjustment to the size of N, it can be employed by all carriers, each operating in different bands, instead of the many different large and ungainly antennas each uses on different mounting poles.

Further, the element 22 while being shown in FIGS. 1-2 with only one slope change 41 of the flare angles of the cavity, can be formed with multiple such slope changes to enhance other sections of the broadband spectrum it is adapted to receive.

While employable in individual antenna elements 22, the elements 22 may also be coupled electrically for added gain and beam steering and for multiple RF stream MIMO type communications for 3G and 4G cellular systems. As shown in FIG. 3-5, using a plurality of elements 22 each substantially identical to the other, and each capable of RF transmission and reception across a wide array of frequencies to form an array antenna, the device provides an elegantly simple solution to forming antennas which are highly customizable for frequency, gain, polarization, steering, and other factors, for the user and which will not interfere with each other in close proximity.

As depicted in FIG. 5, an array device 11 is formed using the individual elements 22 which are electrically connected to form an elongated array 50 and the individual arrays 50 may be employed as array antennas in parallel mountings preferably with a ground plane 52 for concurrent RF transmission and reception of multiple RF streams in MIMO and other multi stream 3G and 4G communications schemes and with exceptional performance.

The unique configuration of the individual antenna radiator elements 22, with the flare angles of the edges of the two halves of the element forming a bump or node in a mid portion, provides excellent transmission and reception performance in a wide band of frequencies between 680 MHz to 2200 MHz. Such performance in such a broad bandwidth is accomplished with a plurality of the formed array 50 as individual antennas operating a very close spacing with as little as a 5½ inch separation "S" in an array device 11. The ability for such close spacing of the radiating and receiving elements provided by the arrays 50 without interference with operation of the adjacent array 50 antennas in the formed array device 11 of FIG. 5, is a major improvement as no smart antenna switching, or multiplexing or temporary de-energizing of adjacent antennas of the multi stream array is required. This allows for a much smaller footprint and much faster 3G and 4G transmissions since all the formed arrays 50 operating as antennas can concurrently operate to transmit and receive individual RF streams concurrently and continuously without switching or multiplexing of the adjacent array 50 which are concurrently handling their own RF streams.

This ability overcomes the problems associated with current MIMO and multiple antenna arrays for producing multiple RF streams for 3G and 4G systems which as noted must either separate all the antennas in the array from each other by a distance of ½ the wavelength of the longest bandwidth, or, use multiplexing and smart switching techniques and software to turn off adjacent closely spaced antennas to avoid interference.

While all of the fundamental characteristics and features of the disclose antenna element and with variable slope defining an aperture for reception and transmission of RF energy have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A flat planar broadband antenna comprising:

a substrate;

a first substrate surface having a first planar surface, a portion of said first planar surface of said substrate being covered with a conductive material and a portion of which being uncovered;

said conductive material forming an antenna element having two half portions, each of said half portions having a substantially equal area of said conductive material, positioned on opposite sides of a cavity therebetween formed by said uncovered portion;

said cavity having a mouth area adjacent to a first edge of said substrate and extending between respective opposing side edges of both said half portions;

said cavity having a cross section diminishing in size from a widest point closest to said first side edge, to a narrowest point closest to a second edge of said substrate, opposite said first edge;

a first linear edge portion of said side edges defining a first flare angle portion of both of said side edges in a first portion of said cavity extending between said mouth and two opposing first points on said side edges;

a second portion of said cavity defined by opposing curved portions of said side edges extending from said respective first points on said side edges, to said narrowest point of said cavity;

said second portion of said cavity providing means to improve performance in a midrange of said antenna between a highest frequency determined by said narrowest point and lowest frequency determined by said widest point;

a curvilineal cavity extending from said narrowest point in a direction substantially parallel to said first edge, toward a side edge of said substrate communicating between said first edge and said second edge; and a feed line positioned on a second planar surface of said substrate on an opposite side of said substrate from said first planar surface, said feed line being electrically connected to the conductive material of one of said two half portions of said antenna element.

2. The antenna of claim 1 additionally comprising:

said widest point being an equal to one of a full or halve wave distance of a frequency substantially 680 MHz.

3. The broadband antenna element of claim 2, further comprising:

a pair of "L" shaped conductors extending from each respective said distal tip of said half portions; and each respective said conductor electrically communicating between a respective said distal tip of one said half portion and a respective body portion of the same said half portion from which it extends.

4. The antenna of claim 1 additionally comprising:

an electrical coupling of a plurality of said antennas to form an elongated array;

a plurality of said elongated arrays engaged in parallel on a mounting surface; and each of said plurality configured for operative engagement to RF transmission and reception equipment and so engaged, each capable of continuous, concurrent, RF transmissions and reception without interfering with adjacent said elongated arrays.

5. The broadband antenna element of claim 4, further comprising:

a pair of "L" shaped conductors extending from each respective said distal tip of said half portions; and each respective said conductor electrically communicating between a respective said distal tip of one said half portion and a respective body portion of the same said half portion from which it extends.

6. The broadband antenna element of claim 1, further comprising:

said pair of halves having substantially identical shapes, extending in opposite directions to said distal tips and having the appearance of a whale's tail when viewed from a position normal to the substrate surface on which said halves are formed.

7. The broadband antenna element of claim 1, further comprising:

a pair of "L" shaped conductors extending from each respective said distal tip of said half portions; and each respective said conductor electrically communicating between a respective said distal tip of one said half portion and a respective body portion of the same said half portion from which it extends.

8. The broadband antenna element of claim 1, further comprising:

a plurality of said antenna elements formed on said substrate adjacent to each other forming a said substrate with multiple said antenna elements thereon; and a plurality of said substrates, each having said multiple antenna elements; and each of said plurality electrically engageable to each other to thereby form an array, said array providing means for increased gain and/or a steering of an RF signal therefrom.

9. A broadband antenna element, comprising:

a substrate;

a first substrate surface, a portion of which is covered with a conductive material, and a portion of which is uncovered;

said conductive material forming a pair of element halves having substantially identical shapes, said halves each extending in opposite directions to distal tips;

a first cavity formed by said uncovered portion in-between said pair of element halves;

said first cavity having a mouth portion, said mouth portion positioned at a first edge along a line extending between said distal tips;

said first cavity reducing in cross-section according to a linear first slope of the opposing edges of said two halves facing said mouth portion, to a mid point;

said first cavity decreasing in cross-section according to a second slope extending along an equal opposing curve of both said opposing side edges from said mid point to a narrowest point of said first cavity;

a second cavity extending away from said narrowest point of said first cavity in a curved direction into a first one of said two halves; and a feedline electrically communicating at a first end with a second one of said two halves from said first one, and adapted at a second end for electrical communication with an RF receiver or transceiver.

10. The broadband antenna element of claim 9, further comprising:

a pair of "L" shaped conductors extending from each respective said distal tip of said half portions; and each respective said conductor electrically communicating between a respective said distal tip of one said half portion and a respective body portion of the same said half portion from which it extends.

* * * * *